United States Patent [19]

Walkinshaw et al.

[11] Patent Number: 4,843,786

[45] Date of Patent: Jul. 4, 1989

[54] ENCLOSURE CONDITIONED HOUSING SYSTEM

[76] Inventors: Douglas S. Walkinshaw, 2344 Haddington Crescent, Ottawa, Ontario, Canada, K1H 8J4; Stuart R. Walkinshaw, 248 Fitton's Road, East, Orillia, Ontario, Canada, L3V 2J8

[21] Appl. No.: 155,615

[22] Filed: Feb. 12, 1988

[30] Foreign Application Priority Data

Feb. 20, 1987 [CA] Canada ..... 530186

[51] Int. Cl.[4] ..... F24F 7/00

[52] U.S. Cl. ..... 52/169.5; 52/302; 52/303; 98/31.5; 98/31; 98/32

[58] Field of Search ..... 52/169.1, 169.5, 169.6, 52/169.7, 169.8, 169.14, 302, 303, 479; 98/31, 32, 31.5, 33.1, 34.5, 40.01, 42.01, 42.02, 42.05

[56] References Cited

U.S. PATENT DOCUMENTS

| | | | |
|---|---|---|---|
| 2,593,424 | 4/1952 | Edgerly . | |
| 2,649,726 | 8/1953 | Wyman . | |
| 2,767,639 | 10/1956 | Johnson et al. . | |
| 3,771,273 | 11/1973 | Brodie | 52/302 X |
| 4,075,799 | 2/1978 | Lemelson | 52/169.5 |
| 4,295,415 | 10/1981 | Schneider, Jr. | 98/31 |
| 4,296,798 | 10/1981 | Schramm | 52/303 X |
| 4,467,587 | 8/1984 | Montagnan | 52/169.14 |
| 4,578,912 | 4/1986 | Ericsson | 52/169.5 |
| 4,620,398 | 11/1986 | Wallin | 52/169.1 |

FOREIGN PATENT DOCUMENTS

| | | | |
|---|---|---|---|
| 2453 | 6/1873 | Canada . | |
| 39178 | 6/1892 | Canada . | |
| 56592 | 7/1897 | Canada . | |
| 95779 | 8/1905 | Canada . | |
| 355278 | 1/1936 | Canada . | |
| 492933 | 5/1953 | Canada . | |
| 1000105 | 11/1976 | Canada . | |
| 1095316 | 2/1981 | Canada . | |
| 1189672 | 7/1985 | Canada . | |
| 55128 | 3/1985 | Japan | 52/169.6 |
| 121662 | 3/1948 | Sweden | 52/169.6 |
| 391976 | 3/1977 | Sweden | 52/169.5 |

OTHER PUBLICATIONS

*Architecture,* Mar. 1987, "Radonproofing", pp. 85 and 86.

*Primary Examiner*—David A. Scherbel
*Assistant Examiner*—Richard E. Chilcot, Jr.
*Attorney, Agent, or Firm*—Hoffman, Wasson, Fallow & Gitler

[57] ABSTRACT

A continuous building basement wall and floor cavity, formed by the foundation wall and floor enclosure on the outside, and an attached inner air and vapor barrier structure, insulated as appropriate, is drained and ventilated to inhibit and prevent soil moisture and gases, such as radon and methane, from entering the basement living space. The air exhausted from the cavity can be drawn from the basement living space, as well as from the surrounding soil and the outdoors. This ventilation of the cavity serves to thermally condition the basement enclosure structure and, coincidentally, to beneficially augment the ventilation rate of the living space. Cavity exhaust air can be used for combustion air supply and heat recovery pruposes. Such a cavity can be economically constructed, using novel modifications to current construction practices, in both new and existing building structures. Introduction of this ventilated cavity in building basements serves to create basement living space of a thermal and environmental quality which is comparable to that of above-ground space.

19 Claims, 4 Drawing Sheets

ENCLOSURE CONDITIONED HOUSING SYSTEM

BACKGROUND OF THE INVENTION

This invention relates to a method of building construction that prevents or reduces the amount of soil and basement enclosure-sourced gases, moisture and biological and physical agents entering basement and other living spaces in building structures.

It is well known that buildings tend to act as chimneys or "stacks" throughout most of the year by drawing in cooler outside air through enclosure openings positioned below the neutral pressure plane of the building, which is located at about building mid-height, while simultaneously exhausting the warmed inside air above the neutral pressure plane of the building. This buoyancy-induced stack effect acts on all but hot summer days. It has been discovered only recently, however, that harmful and unpleasant substances are drawn from the surrounding soil, through basement cracks and openings, into the living space as a rsult of this stack effect. These unwanted harmful and unpleasant substances in the soil can also be forced into the living space through the action of wind pressure.

In addition to these two soil pollutant entry mechanisms, liquids in the soil containing harmful and unpleasant substances may penetrate basement wall and slab materials through capillary action and hence diffuse into the living space.

Sump pump, floor drain and service openings provide a fourth mechanism for the introduction of these harmful and unpleasant substances.

One group of pollutants that enter basements and are of current concern is radioactive radon gas and its progeny. These radionuclides emit the alpha radiation which is postulated to cause about five percent of all lung cancers making it the second leading cause of lung cancer after tobacco smoke. These radionuclides are emitted by rock, soil, underground water, and building materials such as concrete. Some five million North American homes are estimated to contain radon levels above the United States Environmental Protection Agency action level of 0.02 WL for radon progeny.

Other pollutants arising in the soil as a result of its natural organic content and the presence of waste materials, lawn fertilizers and herbicides therein, include methane and other gases, and fungal propagules and gaseous emissions. These gases and biological agents are also brought into the living space by means of these four basement entry mechanisms, as described above.

In addition to transporting dissolved gases, bacteria and soil fungal propagules into the living space, the introduction of soil moisture into the basement can result in damage and the formation of mold in affected building materials, carpets and furnishings, as well as coincidently attracting spiders, silverfish, centipedes, and other such insects. Moreover, these molds produce objectionable odors and/or allergic reactions. In some cases they cause illnesses and possibly compromise the human immune system. In addition, the occurrence of insects generally results in the use of pesticides indoors which introduces other harmful substances into the living space. Correcting basement concrete wall cracking and leakage is possibly the most costly and frequent repair in new dwellings.

Various methods have been proposed to reduce or prevent the entry of soil pollutants. These have included plugging cracks in foundation slabs and basement walls, and sealing and venting sump pumps and other such openings. With such an ad hoc preventative approach, however, it is virtually impossible to permanently seal all cracks, and thus, the entry of soil pollutants or foundation water by this mechanism is never fully and permanently prevented. As well, as the air pressure of the basement area is generally at a lesser air pressure than that of the external soil air, soil gases are drawn into any openings into the building structure.

Other methods have also been proposed, but these are also problematic. These other methods include exhausting the weeping tile to the outdoor air so as to depressurize around the slabwall interface, and exhausting or pressurizing a gravel layer below the slab so that any soil gases may escape to the atmosphere without entering the basement. However, such approaches do not deal with finished basement water leakage and condensation problems. As well, weeping tile can become plugged and the layer of gravel may not allow free air movement to the exhaust. Further, since moisture and entrained gases can travel through the concrete by a combination of capillary action followed by near surface diffusion, this entry mechanism is not adequately dealt with by subslab ventilation. As well, basement foundation building materials such as concrete and biocide-treated wood can themselves be sources of basement living space air pollutants, and this source of pollutants is not adequately addressed by other methods.

SUMMARY OF THE INVENTION

It is thus the object of the present invention to provide a simple and effective method for preventing or reducing soil and basement enclosure material-sourced gases, moisture and biological and physical agents (i.e. soil and building material pollutants) from entering the living space of building structures.

It is also an object of this invention to provide a system that safely accommodates basement slab and wall water leakage, and reduces or eliminates basement living space condensation, any of which can result in moisture, mold and mildew damage to building and furnishing materials, and biological air pollution.

It is a further object of this invention to provide a thermally comfortable living environment which can be finished as confidently as above-ground living spaces, and thereby significantly expand the amount of high quality living space available within buildings with basements.

Finally, it is the object of this invention to provide a convenient source of combustion and draft dilution air for fuel-burning devices such as furnaces, hot water heaters and fireplaces which otherwise might be subject to backdrafting problems.

This invention involves the construction of a sealed cavity around the inside of the outer walls and base of new and existing building basements. To create this cavity, novel modifications to current methods for constructing exterior finished walls and raised floors are employed. When this cavity is properly constructed, ventilated and drained, all of the objectives can be achieved in an economic and reliable fashion.

BRIEF DESCRIPTION OF THE DRAWINGS

The basis concept of the invention is shown in FIG. 1, currently preferred embodiments are illustrated in FIGS. 2 and 3, and a configuration for implementing this invention in an energy efficient, tight enclosure building is shown in FIG. 4.

DESCRIPTION OF THE PREFERRED EMBODIMENTS

Figure 1:
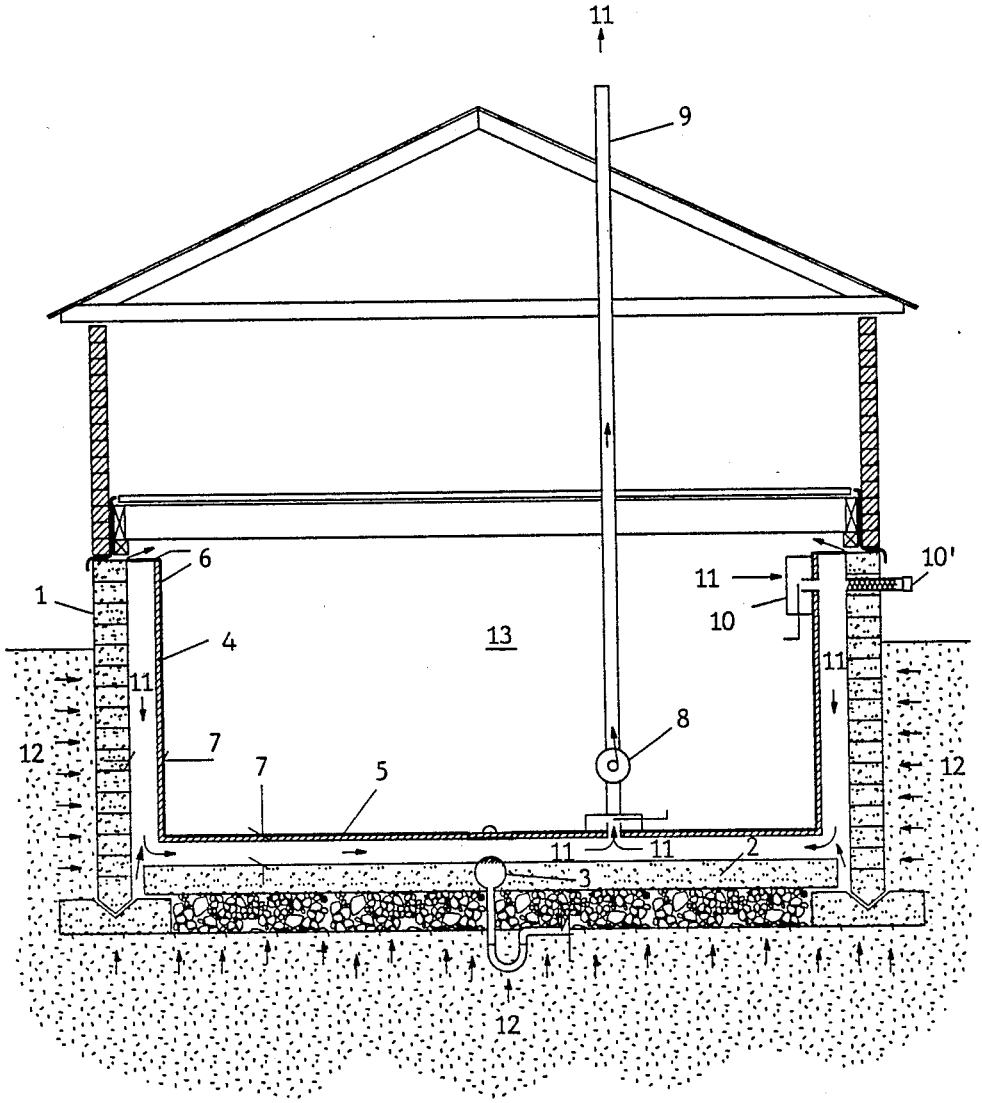

The present invention is illustrated in FIG. 1. It comprises a conventional building basement construction with outer walls 1, and an outer base 2 having a floor drain or other means for water removal 3. Composite inner walls 4 are supported in spaced relation to the outer walls and a composite inner floor 5 is supported in spaced relation to the outer base. There is a substantially continuous vapor barrier 6 at the inner walls and inner floor and their juncture, and between the inner and outer walls, near their top. Thus, a continuous, sealed cavity 7 extending completely around the inner walls (below grade portion, at least) and inner base is provided. There is a means, such as a blower 8, exhaust pipe 9, and one or more dampered intakes from the indoors 10 and/or the outdoors 10', for (de)pressurizing the cavity and ventilating gaseous, viable and particulate air borne pollutants and water vapour 11 from the cavity to the outdoors. In this way, ingress of vapor and gaseous pollutants 12, originating in the soil and cavity materials, into the living space 13, is inhibited or prevented.

it is to be understood that the term "vapor barrier" as used in the preceding paragraph and herafter is intended to cover a barrier which is substantially impermeable not only to vapors such as water vapor but also to gases such as radon and air, and which is capable of withstanding small pressure differentials across its surface. In a preferred arrangement, water which collects by leakage or condensation in the cavity can be removed by a drain 3 and/or ventilation 11. It should be noted that, following the convention of the building industry, this cavity refers to the space between the vapor barrier and the outer wall 1 or base 2, whether or not there are studs or insulation within it. It is a requirement of this invention that air movement be possible throughout this cavity.

Figure 2:
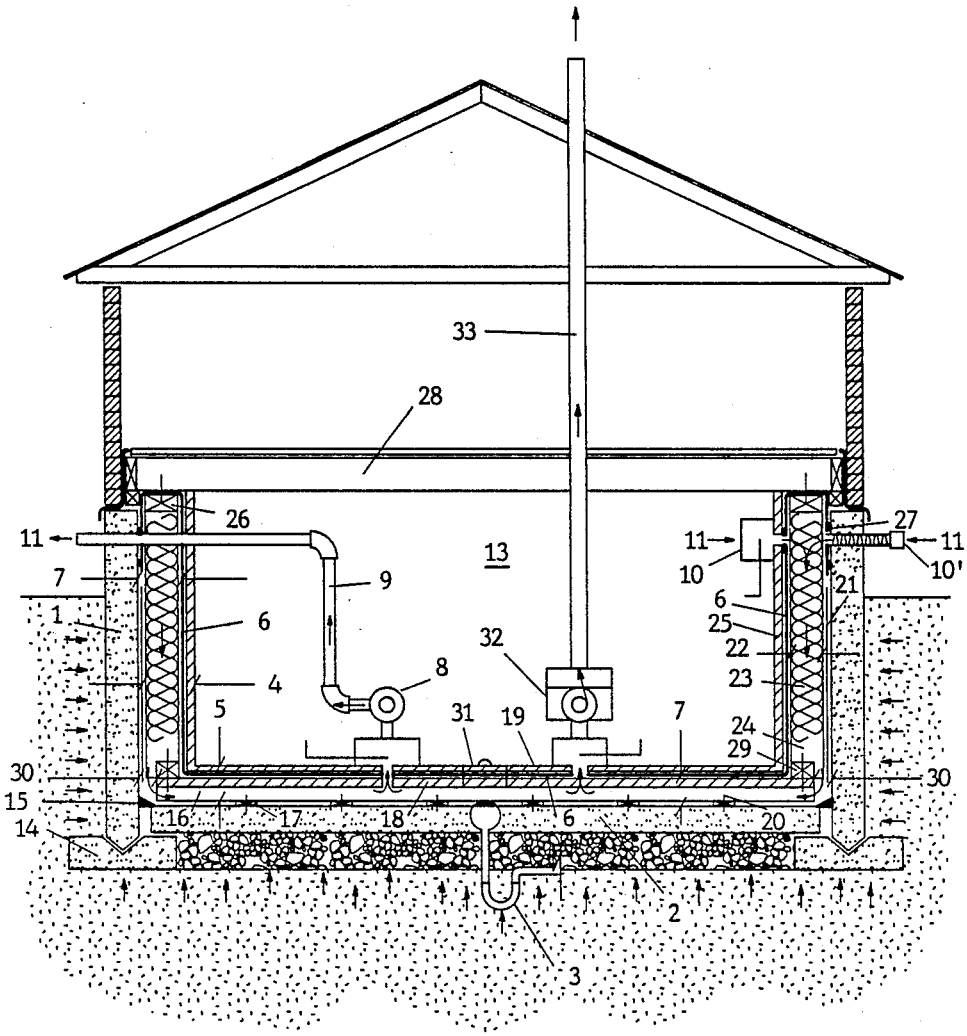
Figure 3:
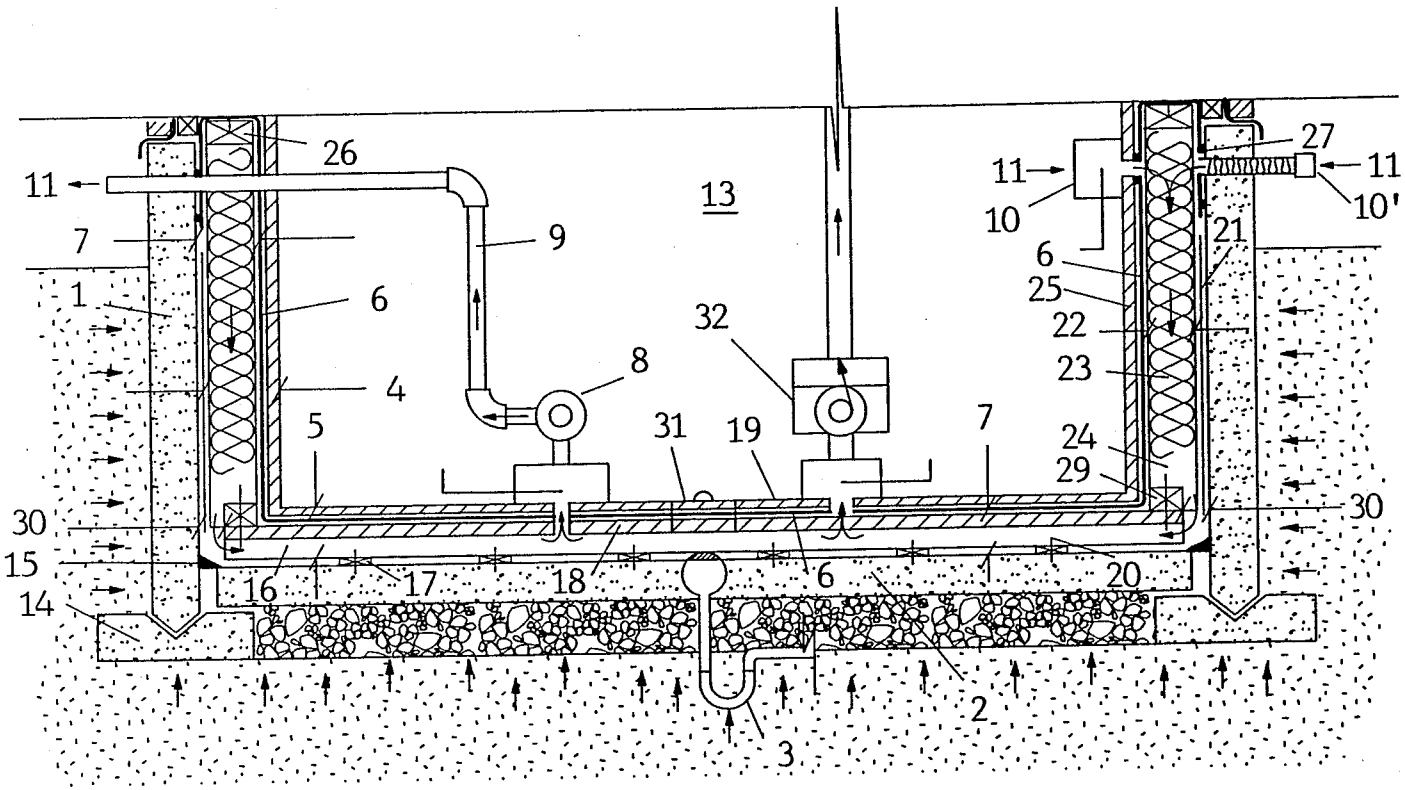

Referring to FIG. 2, and to FIG. 3 which shows an enlargement of the system construction details, there is shown a presently preferred embodiment of this basement construction system for a building structure. Situated below or partly below ground level of the building structure is provided a basement area or living space 13. Constructed below and around this basement living space is a continuous, intervening cavity or chamber 7. This cavity is defined at its outer limit by a foundation base 2, with the continuous foundation side walls 1 extending thereabove. The outer limit cavity side walls and footings 14 are constructed according to good current practice, typically using concrete blocks or poured concrete. The outer limit foundation base may be concrete or another system such as gravel and soil, for example, suitable for supporting the composite floor 5, and for cavity air movement, pressure containment, drainage and, in the case of a pressurized cavity, exhaust. The foundation side walls may be provided with windows (not shown), while the foundation base must have a mecanism, such as a slab sloping to the drain 3, for removing cavity water condensate and enclosure leakage water. The crack at the juncture of the poured concrete foundation base and enclosure walls, and any other noticeable cracks, should be sealed, typically with caulking 15. Alternatively, if building codes require a sheet of polyethylene under the base or slab 2, then this material can be lapped and caulked to the outer wall 1.

Defining the inner limit of the continuous cavity 7 is the vapor barrier 6 in the composite basement floor 5 and composite walls 4.

In an embodiment presently preferred, the composite floor is constructed, proceeding from its outer to inner limits, with biocide-treated wood beams 16 resting on cedar shims 17 which are separated from the concrete by strips of polyethylene (not sown), biocide-treated plywood 18 fastened to the beams, overlapping sheets of polyethylene 6, and carpet or subflooring 19. The polyethylene sheets are not required when adjacent edges of the treated plywood sheets are close-fitting and supported by the beams so that an effective air and vapor barrier is formed by these sheets. The cedar shims are fixed in place with nails 20 passing through the beams and shims, into the slab.

Insulation in the composite floor (not shown) can be placed between the beams. If glass fibre bats are used for this purpose, they can be supported by fastening a plastic mesh, for example, to the underside of the beams.

In this embodiment, the composite walls 4 are constructed on the treated plywood subfloor surface 18. Proceeding from their outer to inner limits, the composite walls have moisture-resistant felt paper 21 below grade between the side walls and the insulation (if required by building codes) fastened to spaced vertical stud supports 22, which are gapped slightly from the foundation walls, air permeable glass fibre insulation 23 between the studs, except for a gap of some 6 inches at the wall base 24 (as required by building codes), sheets of overlapping polethylene 6 stapled to the studs, and gypsum board or other panelling 25.

At the top of the wall cavity, the polethylene is lapped over the stud wall top plate 26 and pressed against a caulking bead 27 on the foundation wall 1. Alternatively, the cavity is later sealed at the top of the composite wall by caulking or foaming sealant into the cracks at a top plate. The composite wall is fastened at the top by nailing this top plate to the floor joists 28.

The composite wall is fastened at its base by nailing a bottom plate 29 to the treated plywood 18. A gap 30 of one inch or so is left between the outer wall 1 and the edges of the bottom plate and the treated plywood, so as to ensure continuity of the cavity between its wall and floor portions. The seal at the juncture of the composite walls and composite floor is completed, normally by lapping polyethylene from the wall onto the treated plywood.

Typically, the resultant cavity 7 between the vapor barrier in the composite wall and the foundation walls and floor slab, through which air can move, is one to several inches in depth. The vapor barrier 6 is of a sufficiently strong material to withstand pressure differences of a few pascals across its surface. Prior to covering the cavity vapour barrier material with any surface finishing material, seals at all junctures are carefully checked.

An air sealed, gasketted cavity entrance hatch 31 is provided through the inner composite floor for cavity, drain or sump pump inspection, for example.

Located at the top of the continuous cavity are one or more air intake openings to the living space 10 and/or to the outdoors 10'. Typically, two intakes are installed in each wall. These openings have removable caps and/or dampers, and filters. In an automated approach, the dampers can be pressure-activated.

Outside air intakes 10' are designed to eliminate or reduce rain and snow intrusion and possible blockage, and entry of insects and animals. These openings can be located in adjoining spaces such as attics and garages, thereby eliminating snow and rain concerns and possibly improving cavity thermal and humidity conditions, while coincidently providing useful ventilation of these adjoining spaces. Inside air intake via openings 10 can be piped from rooms in upper floors or in the basement, depending upon living space air circulation and exhaust requirements.

A cavity out-take or exhaust pipe 9, protected against rain and snow intrusion and freezing blockage, extends through the vapor barrier into the bottom section of the continuous cavity.

In order to ensure effective and continuous ventilation of the cavity in which the soil and basement enclosure-sourced pollutants and moisture will tend to accumulate, a blower 8 is installed in the out-take pipe and normally operated year round. In this way, the cavity is maintained at a slightly negative pressure relative to the living space, thereby ensuring that cavity pollutants and water vapor do not enter the living space through any small openings in the vapor barrier.

The required capacity of blower to achieve this negative cavity pressure depends upon: the amount of cavity air leakage; the desired amount of living space ventilation to be coincidently achieved; and the combustion air requirements to be supplied by this blower.

Typical cavity leakage might be in the order of 50 cubic feet per minute (cfm). Some of this leakage could come from the basement living space, an the remainder from the soil and outdoors.

When cavity ventilation air 11 is taken from the interior living space, coincident healthful ventilation of the living space is achieved, as the negative pressure so induced draws in outside air through cracks and openings. Such infiltration ventilation coincidently reduces winter moisture condensation and freezing in building enclosure cracks, at windows and doors, for example.

Ventilation of the cavity with living space air normally is beneficial in several ways. This action tends to condition the cavity temperature to that of the living space, making for more comfortable floors, for example, while conserving energy and reducing the possibility of condensation on the living space side of the vapor barrier. It will also tend to keep the cavity dry, thereby increasing material life. Such a cavity drying action will occur as long as the cavity air temperature is above its dewpoint. Dehumidification and air conditioning of the basement living space air will assist in this regard.

If there is a concern with cavity humidity levels due to high humidity air intake, then this intake can be reduced by closing intakes 10 and/or 10', and reducing cavity ventilation to that of leakage only, while maintaining cavity depressurization. Cavity condensate, itself, should not pose a problem as it will condense on the relatively colder, moisture-damage resistant foundation walls 1 and floor 2, and run to the drain or later be evaporated and ventilated out again.

A blower capacity in the 150 cfm range at 100 Pascals pressure, depending upon flow resistance, building size, and cavity leakage, is required to maintain a living space ventilation rate of 0.35 air changes per hour (as proposed in Standard 62-1981R by the American Society of Heating, Refrigerating and Air-Conditioning Engineers (ASHRAE)).

If combustion devices such as fuel burning furnaces, hot water heaters or fireplaces are present, these must have dedicated air supplies to avoid possible backdrafting resulting from living space depressurization which can arise using this system. For such devices, the cavity exhaust can supply the required combustion air, rather than bringing in cold, outdoor air as is normally done under safety regulations. This can be achieved by coupling the cavity exhaust pipe 9 with the combustion device air intake. Alternatively, induced or forced draft furnaces 32, with their own blowers and exhaust pipes 33, can take their combustion and venting air directly from the cavity.

In "as built" cases where the vapor barrier is found to have inconsequential leakage, or the cavity pollutants and/or moisture levels are at safe concentrations, the cavity can be ventilated either actively or passively, and at positive, negative or neutral pressure relative to the adjacent basement living space. Positive pressure cavity ventilation has the added advantage of reducing the quantity of soil pollutants entering the cavity.

Positive cavity pressure venting can be achieved passively, by wind and/or thermal stack action, for example, or actively by reversing the direction of the fan-induced air motion 11 so that air enters the cavity from pipe 9 and exhausts through outside openings 10'. This is the reverse direction to that shown in FIGS. 2 and 3. Note that cavity systems with interior openings 10 only, normally cannot be operated under positive pressure as soil pollutants would be vented into the living space. However, if the cavity is operated under positive pressure, cavity exhaust through opening 10' may not be required, provided the outer limit cavity walls and foundation base and surrounding soil are sufficiently permeable to allow for the required cavity exhaust.

In comparison to conventional buildings, energy efficient buildings typically have: more insulation in the above-the-frost-penetration-line portion of their enclosures; significantly less above-ground enclosure leakage; balanced, energy recovery, mechanical air exchange with the outdoors; and dedicated air supply to combustion devices. The introduction of the present invention into such energy efficient buildings can be achieved in an integrated manner whereby the heat exchanger exhaust blower is coincidently used to achieve cavity depressurization.

Figure 4:
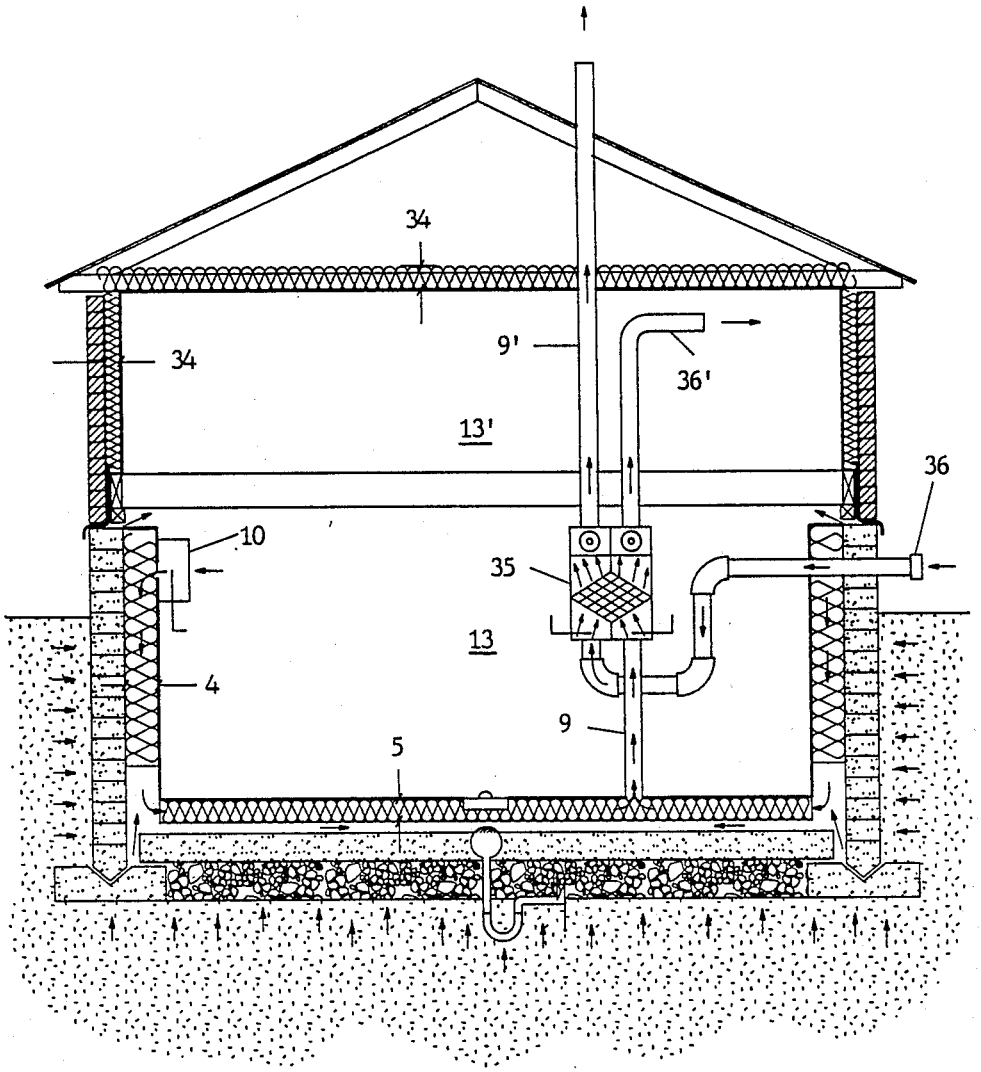

One form of embodiment of this invention in such an energy efficient structure is illustrated in FIG. 4. The enclosure of the building is sealed and insulated to the extent practical, both above-ground 34 according to conventional techniques, and below-ground 4, 5 using the techniques of the current disclosure. At least one cavity air inlet 10 from the basement living space 13, or the upstairs living space 13', is provided in the wall portion of the cavity. An air-to-air heat exchanger 35 exhausts contaminated air from the cavity via pipe 9, and thence to the outdoors via pipe 9', and it draws fresh outside air via one or more pipes 36, to the heat exchanger where it is conditioned by the cavity exhaust air, and then supplied to the living space via one or more pipes 36'.

In this form of embodiment, the drawing of living space air through the enclosure cavity, before it is exhausted, serves to condition the cavity closer to living space temperatures, thereby beneficially warming the basement walls and floor.

The supply rate of the heat exchanger normally is set to meet building code living space air exchange requirements (current proposed rates range from 0.3 to 0.5 living space air changes per hour). To avoid living space overpressurization-induced enclosure condensation, the exhaust rate of the heat exchanger is set to exceed the supply rate by an amount which provides in sum either a balanced or negative living space air exchange rate. To achieve this, the amount of this exceedance is set at the cavity leakage rate from the soil side of the cavity, if this is known. If not, then it is conservatively set at the total cavity leakage rate occuring at the operational cavity pressures, with inlet 10 closed.

The system of the invention reduces or eliminates the possibility of soil and basement enclosure material-sourced pollutants, water and water vapor from entering the basement living space, and reduces the possibility of basement material and furnishings mold and mildew problems. It also provides for the enhancement of thermal comfort in the basement living space, for coincident healthful ventilation of the building living space as desired or required by codes, and for a convenient source of air for use by combustion devices such as furnaces and fireplaces. This invention can be economically installed in new and existing buildings to permit the finishing and habitation of the basement as high quality living space.

What we claim as our invention is:

1. A building basement construction comprising outer walls and an outer base, inner walls supported in space relation to the outer walls, an inner floor supported in spaced relation to the outer base, a substantially continuous vapor barrier at the inner walls and the inner floor and the juncture of the inner walls and inner floor, the vapor barrier extending between the inner and outer walls, near their top, and a continuous, sealed cavity completely around the inner walls and floor, the cavity having an inner limit defined by the vapor barrier and an outer limit defined by the outer walls and outer base, whereby the vapor barrier inhibits or prevents ingress of vapor and gaseous pollutants from the cavity, and means for ventilating pollutants and water vapor from the cavity.

2. A building basement construction as set forth in claim 1 in which the means for ventilating the cavity includes at least one air inlet and at least one air outlet.

3. A building basement construction as set forth in claim 2 in which the means for ventilating the cavity includes a fan which vents the cavity under negative pressure.

4. A building basement construction as set forth in claim 2 in which the means for ventilating the cavity includes a fan which vents the cavity under positive pressure.

5. A building basement construction as set forth in claim 1 in which the substantially continuous vapor barrier is of a polyethylene or similar material.

6. A building basement construction as set forth in claim 1 including in the inner walls and inner floor a thermal insulation barrier.

7. A building basement construction as set forth in claim 6 in which the inner walls and floor include studs and thermal insulation material.

8. A building basement construction as set forth in claim 1 including means for removing water which may collect in the cavity.

9. A building basement construction as set forth in claim 8 in which the means for removing water includes a drainage system in the outer base.

10. A building basement construction as set forth in claim 9 including a sealable hatch in the inner floor for access to the cavity drainage system.

11. A building basement construction as set forth in claim 1 in which the means for ventilating the cavity removes air from a living space within the building thereby increasing outside air infiltration to the living space.

12. A building basement construction as set forth in claim 1 in which the means for ventilating the cavity removes air from a living space within a mechanically ventilated, energy efficient, tight enclosure building living space at a rate equalling that of air supply to the living space, thereby providing the exhaust component of a balanced building living space ventilation system.

13. A building basement construction as set forth in claim 1 in which said ventilation means communicates with the exterior environment.

14. A building basement construction as set forth in claim 1 in which the means for ventilating the cavity directs cavity air to combustion devices such as a fireplace, or a fuel burning furnace or hot water heater.

15. A building basement construction as set forth in claim 1 in which the cavity depth is in the range of one to several inches.

16. A building basement construction as set forth in claim 1 in which the means for ventilating the air in the cavity includes pressure adjustable valves or pipes and filter media in the air inlet or outlet providing the appropriate pressure drop.

17. A building basement construction as set forth in claim 1 in which supply air condensation in the cavity is minimized and inner cavity wall wetting avoided.

18. A building basement construction as set forth in claim 1 in which the inner floor materials below the vapor barrier are resistant to mold, mildew and corrosion.

19. A building basement construction as set forth in claim 1 in which the inner floor is constructed with plywood and beams in a close-fitting fashion such that it acts as a substantially continuous vapor barrier.

* * * * *